US010994307B2

(12) United States Patent
Gialis

(10) Patent No.: US 10,994,307 B2
(45) Date of Patent: May 4, 2021

(54) SORTING TABLE WITH ADJUSTABLE SCREEN

(71) Applicant: PELLENC, Pertuis (FR)

(72) Inventor: Jean-Marc Gialis, Cheval Blanc (FR)

( * ) Notice: Subject to any disclaimer, the term of this patent is extended or adjusted under 35 U.S.C. 154(b) by 175 days.

(21) Appl. No.: 16/331,248

(22) PCT Filed: Sep. 25, 2017

(86) PCT No.: PCT/FR2017/052571

§ 371 (c)(1),
(2) Date: Apr. 24, 2019

(87) PCT Pub. No.: WO2018/078229

PCT Pub. Date: May 3, 2018

(65) Prior Publication Data

US 2019/0240701 A1 Aug. 8, 2019

(30) Foreign Application Priority Data

Oct. 24, 2016 (FR) ..... 16/60277

(51) Int. Cl.
*B07B 1/46* (2006.01)
*B07B 1/15* (2006.01)

(52) U.S. Cl.
CPC ..... *B07B 1/4636* (2013.01); *B07B 1/15* (2013.01)

(58) Field of Classification Search
CPC ..... B07B 1/4636; B07B 1/15; B07B 1/4609; B07B 1/49; B07B 1/14; B65G 2201/0211; B65G 39/10; B65G 39/12
See application file for complete search history.

(56) References Cited

U.S. PATENT DOCUMENTS 5,048,674 A * 9/1991 Wilbur ..... B65G 21/2054 198/836.2
2004/0035764 A1 2/2004 Kreft et al.
2016/0242457 A1* 8/2016 Minnicucci ..... B07B 1/4636

FOREIGN PATENT DOCUMENTS

| | | | |
|---|---|---|---|
| EP | 2223587 | A1 | 9/2010 |
| EP | 2436255 | A1 | 4/2012 |
| EP | 2457671 | A2 | 5/2012 |
| EP | 2644017 | A1 | 10/2013 |
| ES | 2235602 | A1 | 7/2005 |
| FR | 2920278 | A1 | 3/2009 |
| GB | 1295781 | A | 11/1972 |

OTHER PUBLICATIONS

International Search Report for PCT/FR2017/052571.

* cited by examiner

*Primary Examiner* — Charles A Fox
*Assistant Examiner* — Jessica L Burkman
(74) *Attorney, Agent, or Firm* — Egbert Law Offices, PLLC

(57) ABSTRACT

A sorting table with an adjustable screen for fruit, has a series of conveyor/sorter rollers arranged in a sorting plane and parallel to each other, the conveyor/sorter rollers each having at least one sorter section, a spacing being provided respectively between opposing sorter sections of successive conveyor/sorter rollers in order to allow fruit to pass selectively through the table, via said spacing. The sorting table includes conveyor/sorter rollers provided with sorter sections that have an adjustable diameter and a control device for controlling the diameter of the adjustable-diameter sorter sections. Application to sorting a fruit or grape crop.

18 Claims, 6 Drawing Sheets

SORTING TABLE WITH ADJUSTABLE SCREEN

TECHNICAL FIELD

The present invention concerns a sorting table with adjustable screen.

It concerns more precisely a sorting table usable for the elimination of extraneous matter remaining mixed in with a crop of small fruit or a grape harvest. Such a sorting table makes it possible, especially in the case of a grape harvest, to separate on the one hand grape berries or other objects of size and shape similar to grape berries, and on the other hand undesirable objects of a size larger than grape berries and of elongated or flattened shapes such as leaves, stems or leaf-stalks for example. This is the case especially when the grape harvest has previously undergone a stalk-stripping operation.

More generally, the invention can be applied for eliminating in a fruit crop any kind of debris distinct from the fruit, and in particular for a crop of small fruit such as gooseberries, black-currant, blackberries, raspberries, olives, cranberries, huckleberries or still other berries or drupes.

Finally, the invention can also be used for calibrating fruits by simply separating larger fruits from smaller ones.

The invention also finds application in the manufacture of free-standing sorting tables or of tables integrated into a harvesting or vintaging machine.

STATE OF PRIOR ART

The state of art can be illustrated by the following documents.

FR 2920278

EP 2457671

ES 2235602

Known sorting tables, for example the one of document FR 2920278, feature a plurality of parallel conveyor-sorter rollers, arranged in a sorting plane. They are generally arranged in a horizontal or nearly horizontal plane. They can assume a more pronounced incline when they are mounted on a grape-picking vehicle, for example, brought in to follow the irregularities of the terrain. This latter mode of operation is however not a parameter for adjusting the incline.

The conveyor-sorter rollers are regularly spaced and they form a screen.

A crop or grape harvest dumped on an intake area of the sorting table is conveyed in the direction of a discharge end of the sorting table by putting the conveyor-sorter rollers in rotation, all in the same direction.

During the conveying, the fruits or berry grapes may pass through spaces provided between the conveyor-sorter rollers to be collected under the sorting table. On the other hand, the debris of larger size than the fruits of berry grapes, in particular leaf-stalks, leaves, stems or small twigs mixed in with the crop, continue their travel to the discharge end of the sorting table, the table being so shaped as to prevent their passing through the spaces made between the rollers. These items of debris are, on account of their size, their factor of voluminous shape, elongated or flattened, or of their weight, in fact more susceptible to continue their travel parallel to the sorting table than to pass through the sorting table.

When a sorting table is adjusted correctly, only debris arrives at the end of the sorting table and is discarded while all the fruits or grape berries have passed through the sorting table during their travel.

The main parameters for adjustment of a sorting table are the intake rate of the crop or the grapes on the table, the conveying speed, determined by the speed of rotation of the conveyor-sorter rollers, the spaces created between the conveyor-sorter rollers and possibly an incline of the sorting table relative to the horizontal plane. Too narrow spacing between the rollers, excessive speed of rotation or too high a dumping rate result in fruit arriving at the discharge end of the table and being disposed of, together with the debris. Inversely, too wide spacing between the rollers or too slow a rotation speed lead to the undesirable passage of debris through the sorting table, together with the fruit.

The speed of rotation of the conveyor-sorters can be easily adjusted by controlling the driving means for the rotation of the conveyor-sorter rollers.

The screen opening, formed by the spaces between the conveyor-sorter rollers can be modified by adjusting the distance between the axes of the conveyor-sorter rollers. Thus, document EP 2457671 proposes to mount the ends of the conveyor-sorter rollers on link gears perpendicular to their axis.

DISCLOSURE OF THE INVENTION

The aim of the invention is to propose a different means of adjustment of a sorting table, and in particular a quick means of adjustment which allows modifying the screen of the sorting table in real time during a sorting operation.

The invention also has the aim to propose a means of adjustment of a sorting table acting simultaneously on the opening of the screen formed by the table and on the conveying speed of the crop or grapes along the table.

To achieve these goals, the invention proposes a sorting table with adjustable screen for fruits, comprising a succession of conveyor-sorter rollers arranged along a sorting plane and parallel to each other, with the conveyor-sorter rollers each presenting at least a sorter-section, a space being created respectively between sorter-sections in respect to successive conveyor-sorter rollers for selective passing of fruit through the table, through said spaces. In accordance with the invention the sorting table includes conveyor-sorter rollers provided with sorter-sections with adjustable diameter and a control device for the diameter of the sorter sections with adjustable diameter.

It should be specified that the adjustable character of the diameter of the sorter-sections does not necessarily imply that this diameter is constant on the sorter-section along the axis of the conveyor-sorter roller. The diameter of the sorter sections can in effect be modified non-uniformly, for example, with a more significant modification on a central portion of the sorter section and a lesser modification on the edges, always in relation to the axis of the corresponding conveyor-sorter roller. The adjustable character of the diameter of the sorter-sections can thus be understood as applying also to their median diameter. This results, between two sorter-sections facing each other, in a spacing with a larger opening when the median diameter is reduced and in a spacing with a smaller opening when the diameter is increased.

One considers that the sorting table is a sorting table "for fruits" when it is configured for sorting a crop of fleshy pitted fruits, of berries, of drupes and more particularly of a harvest of grapes. In the following description and to simplify matters, reference is simply made to fruits without any limitation concerning the nature of these fruits.

Depending on the type of fruit, the conveyor-sorter rollers may feature one or several sorter sections which form the screen. Generally each roller contains a plurality of sorter sections. The following description makes reference essentially to conveyor-sorter rollers provided with a plurality of sorter sections, without prejudging the number of sorter sections of each roller.

The conveyor-sorter rollers, as well as the sorter sections present a rotational symmetry. Thus it is considered that the sorter sections have an adjustable diameter when their diameter and thus their perimeter can be modified, and adjusted. It should be specified that the adjustment of the diameter of the sorter sections is independent of the passage of fruits between the sorter sections. In particular, the simple deformation of a sorter section under the effect of the passing of a fruit is not considered to be an adjustment of its diameter.

The control device of the diameter of the sorter sections may be a control device run by an operator, or, preferably, an automatic servo control device, so as to be able to adjust the diameter and thus the screen of the sorting table in real time during a sorting operation without interrupting this operation. The control device of the diameter of the sorter sections may present diverse forms of implementation depending on its mode of action on the sorter sections with adjustable diameter. In particular, it may be a mechanical or pneumatic device as becomes clear in the following description.

The diameter control of the sorter sections can be made dependent, for example, on the detection of a quantity of fruits arriving at the end of the sorting table without having passed through the sorting table, or relative to the detection of a quantity of debris remaining among the sorted fruits. A measuring element of a quantity of fruits arriving at the end of the table or a quantity of debris remaining among the sorted fruits can be provided for the automatic control of the control device. It may be an optical element, for example an optical barrier, a balance or in a more sophisticated manner, a camera connected to an image analysis system.

Programming or direct control of the control device of the diameter of the sorter sections may also be done by an operator visually evaluating the operation of the sorting table.

The sorter sections of the rollers have two distinct functions. A first function is to constitute a screen on account of the spaces made between the sorter sections facing each other. These spaces in effect enable the fruits to pass through the sorting table and thus to be separated from the debris which continues to be conveyed towards an exit from the sorting table.

A second function of the sorter sections, and more generally of the conveyor-sorter rollers, is a conveying function. In fact the conveying of the crop dumped on the sorting table in the direction of an exit of the sorting table is brought about by the rotation of the conveyor-sorter rollers, these rollers being preferably all driven at the same rotational speed in the same sense of rotation.

Modification of the diameter of the sorter sections has two distinct effects. A first effect is to modify the spacing between the sorter sections and thus the opening of the screen of the sorting table. In effect, when the diameter of the sorter sections facing each other is increased, the spacing between these sections is reduced. Inversely, when the diameter of the sorter sections is diminished, the spacing and thus the opening of the screen become wider.

A regular arrangement of the sorter rollers does indeed allow providing a uniform opening of the screen. This is however not a necessary characteristic. It is possible to envisage adjusting the sorting table with an increasing or decreasing opening of the screen along an axis parallel to the conveying direction, for example.

A second effect of the modification of the diameter of the sorter-sections s a change of the conveying speed of the crop on the sorting table.

In fact for a same rotational speed of the conveyor-sorter rollers, the tangential speed on the surface of the sorter sections increases with the diameter of these sorter sections. Now, a greater tangential speed has the effect of resulting in faster conveying of the crop from an intake zone in the direction of a discharge end of the sorting table.

Additionally, it should be specified that the conveying can also be obtained, over a portion of the sorting table, by simple conveyor rollers which have no fruit sorting function but simply a conveying function and possibly a function of distributing fruits and debris at the intake of the screen, or even a sorting function of liquids or debris items of smaller size than the fruits, such as seeds and grape juice in the case of a grape crop, for example. These rollers are preferably provided at the beginning end of the table in an area of dumping and spreading of the crop or the grape berries. They do not have any passages which would let the fruits pass through the sorting table but they may have narrower passages for letting juice flow through or letting debris pass through that is of smaller size than the fruits, such as seeds or stones.

Furthermore, one may notice that all sections of all conveyor-sorter rollers do not necessarily have adjustable diameters. An alternation of sorter sections with adjustable diameters and of sorter sections with fixed diameters, along a parallel axis in a conveying direction on the sorting table, although being a less favorable solution, may suffice for the adjustment of the screen of the sorting table.

The sorter sections with adjustable diameter include preferably an outer deformable wall. This wall may be formed by a casing, a sleeve or a membrane of an elastic natural material or a thermoplastic elastomer, for example, of rubber or of polyurethane. The deformable character of the wall allows it to adapt to the diameter of the sorter section while at the same time constituting a jacket that is tight against the juices of the conveyed fruits. Its imperviousness facilitates cleaning of the sorting table and protects the internal elements of the conveyor-sorter rollers.

According to a preferred implementation of the invention, the sorting table, and in particular the control device of the diameter of the sorter sections with adjustable diameter may include a source of pressure-controlled fluid connected respectively to an internal chamber of the conveyor-sorter rollers provided with sorter sections with adjustable diameters. In this case, the internal chamber is in fluid communication with the deformable wall. Thus, the control device of the diameter of the sorter sections is able to act by modifying the pressure of the fluid in the internal chamber of the conveyor-sorter rollers. Modification of the fluid pressure enables deforming the deformable wall and thus to adjust the diameter of the sorter sections. The deformation may be similar to inflation or deflation of the deformable wall of a sorter section.

The source of pressure-controlled fluid may be, for example, a source under pressure or under depression relative to atmospheric pressure. It may preferably be a source of air under pressure. The fluid may also be a liquid, such as water or oil, for example.

The exterior deformable wall of the sorter sections may also constitute a wall of the aforementioned internal chamber.

According to another possibility the internal chamber may present a rigid wall, the exterior deformable wall forming a sheath around the rigid wall. The sheath may present itself in the form of a sleeve or a membrane which are described further down.

According to a preferred implementation of the conveyor-sorter rollers they may include a plurality of sorter-sections arranged along a roller axis. In that case, the sorter-sections are respectively separated by annular collars protruding on the sorter-sections.

The annular collars facilitate the selective passage of the fruits through the sorting table which is to say in the spaces made between the sorter rollers. They also enable the conveying of voluminous debris.

The annular collars which may preferably present a diameter greater than the maximum diameter of the sorter rollers, also participate in the conveying of the crop on the sorting table.

Furthermore, the annular collars of adjacent conveyor-sorter rollers separating opposing sorter sections may be essentially aligned along planes perpendicular to the conveying rollers, and present essentially adjacent ridges.

The annular collars are considered to present essentially adjacent ridges when the ridges are mutually aligned perpendicularly to the axis of the conveyor-sorter rollers but also when the ridges are slightly offset perpendicularly to the axis of the conveyor-sorter rollers in the median plane of the sorting table and in the vicinity of this plane. In this latter case, the collars of adjacent rollers are in an interlocked configuration by presenting also mutually adjacent flanks.

It should be specified that in particular implementations of the sorting table of the invention, it is possible to configure the conveyor-sorter rollers without collars or to configure them so that each conveyor-sorter roller only includes a single sorter-section. In the description below, reference is made however to conveyor-sorter rollers with a plurality of sorter-sections, separated respectively by a plurality of collars. Each sorter-section thus includes a collar at each of its ends and two successive sorter-sections are separated by the same collar.

According to a particular implementation of the conveyor-sorter rollers, each sorter-section may present a membrane mounted between two successive annular collars, the membranes of the sorter-sections then forming the deformable wall of the sorter-section.

According to another possibility, the conveyor-sorter rollers may include a sleeve forming the deformable wall respectively of a plurality of sorter-sections.

In this case, the sleeve may present areas of excessive thickness forming directly the annular collars.

According to another possibility, the sleeve may also present annular grooves in which the annular collars are inserted.

Rather than being inserted on a membrane common to several sorter-sections, the annular collars may also be mounted on a central shaft of the conveyor-sorter rollers. The central shaft may be constituted, for example, by the internal chamber with rigid wall mentioned earlier.

In the case of annular collars mounted on a central shaft, they may present respectively a cylindrical base essentially adjusted to the central shaft. The cylindrical base may then extend under the deformable wall and form a spacer between the annular collars.

In order to improve imperviousness with respect to fruit juice running over the conveyor-sorter rollers, the annular collars may present at least one flexible annular lip pressing against an adjacent sorter-section. The lip is flexible so it can adapt to diameter variations of the sorter-section. Such a flexible lip may be provided on the two sides of a collar separating two sorter-sections.

The sorter-sections may be provided with reliefs. These may be for example pins or ribs extending along planes containing an axis of the conveyor-sorter roller.

Such reliefs allow better grip on the fruits to be sorted and facilitate their passing through the sorting table.

The reliefs may be of one piece with the deformable wall of the sorter-sections. They may also be mounted on the wall and made of a material harder than the deformable wall. Use of a harder material makes it possible to delay, if applicable, wear of the deformable wall.

As indicated previously, modification of the diameter of the sorter-sections may be performed by means of a fluid under pressure or a fluid under vacuum.

The diameter may also be modified by mechanical means without using any fluid.

By way of an example, The sorting table may include conveyor-sorter rollers with an alternating succession of sorter-sections as per a succession pattern, of sorter-sections and protruding annular collars separating the sorter-sections, and the control device of the diameter of the sorter-sections may include an internal actuating shaft concentric with the deformable wall of the sorter-sections and with the annular collars, the actuating shaft being provided with humps spaced according to the same succession pattern. In this case, the actuating shaft presents, respectively in relation to the deformable wall, relative to the sorter-sections and to the collars, a freedom of axial sliding between a first position in which the humps are received in seats adjacent to the annular collars and at least one second position in which the humps coincide with the sorter-sections.

When the humps are received in the seats adjacent to the annular collars, the deformable wall is not constrained and can retract, on a resting surface formed for example by a rigid internal wall or formed directly by the parts of the internal shaft that have no humps.

Inversely, when the humps coincide with the sorter-sections, and in particular with the middle of the sorter-sections, the humps of the actuating shaft serve to raise the deformable wall in order to increase the diameter of the sorter-sections.

The seats for the humps are considered to be adjacent to the annular collars when they are provided in the immediate vicinity of the collars, for example under an edge of the sorter-sections or when the sears are under the annular collars.

The possibilities of implementation of the invention described above essentially call for a deforming wall of the sorter-sections. These are preferred possibilities of implementation of the invention. However, it should be noted that the presence of a deformable wall is not indispensable.

The sorting table may in fact be designed with conveyor-sorter rollers including:

- a cylindrical central cylindrical shaft presenting a first diameter,
- protruding annular collars arranged along the central shaft, by creating respectively between them spaces, and the control device of the diameter of the sorter-sections with adjustable diameter may include:

a plurality of sleeves that are coaxial to the central shaft presents a second diameter greater than the first diameter, and presenting relative to the central shaft a freedom of sliding respectively between a first position in which the sleeves are retracted under the conveying collars and a second position in which the sleeves extend in the spaces between the collars.

In this case, the sorter-sections are formed selectively by one of the central shaft and the sleeves in the second position. When the sleeves are retracted, the central shaft constitutes sorter-sections with a first diameter. Inversely, when the sleeves are extended between the annular collars, it is the sleeves which constitute somehow the sorter-sections. The sorter-sections present in this case, a second diameter, the one of the sleeves which is greater than that of the central shaft on which the sleeves slide.

The sleeves thus are part of the control device of the diameter of the sorter-section and of the sorter-sections themselves of which they increase the diameter.

Such an implementation of the invention is not very useful for sorting juicy fruits because the mechanisms which are not protected by a wall or membrane are subject to becoming dirty and possibilities of cleaning are more complicated.

However, such a sorting table can be useful for sorting dry fruits, such as nuts, for example.

The invention also concerns a sorter conveyor roller for a sorting table such as described above including sorter-sections with adjustable diameter.

Other characteristics and advantages of the invention become clear from the description which follows, in reference to the figures of the drawings. This description is provided for illustrative purposes and is not limiting.

The various figures are shown in free-scale.

DETAILED DESCRIPTION OF MODES OF IMPLEMENTATION OF THE INVENTION

In the following description, identical, similar or equivalent portions of the various figures are marked with the same reference identifiers, so as to facilitate the transfer from one figure to another.

Figure 1:
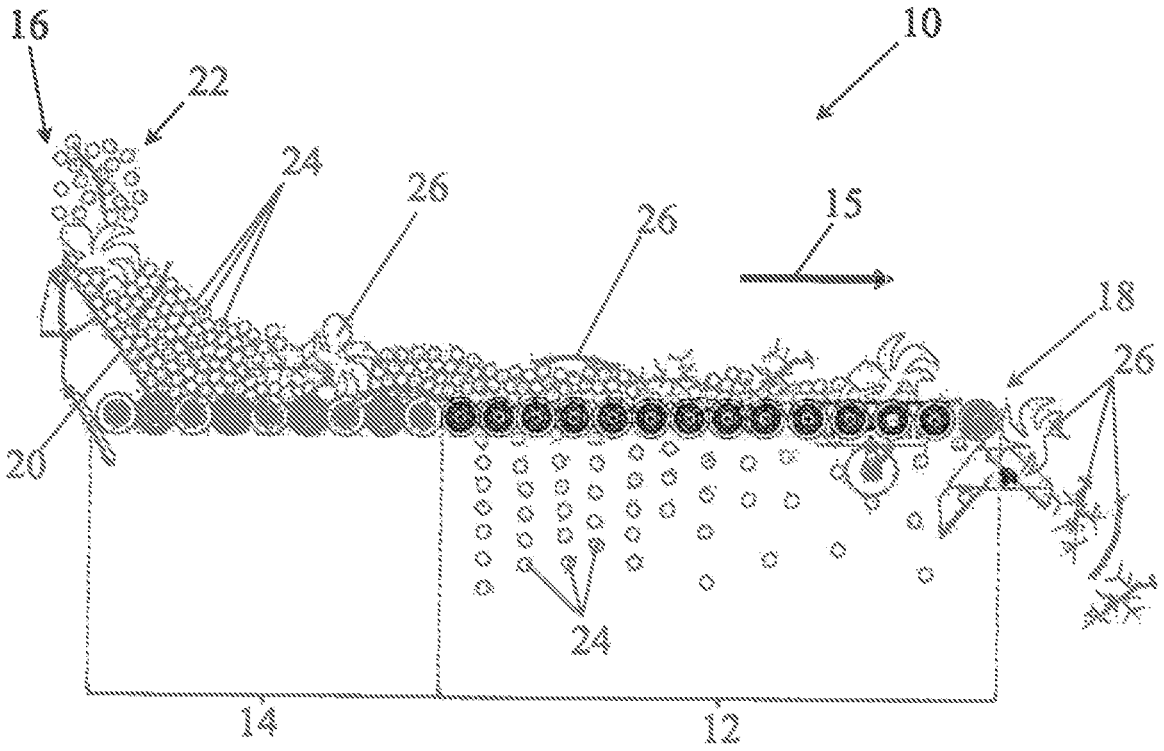
FIG. 1 is a schematic longitudinal sectional drawing of a sorting table in conformance with the invention.

FIG. 1 illustrates the general structure of the sorting table and its operation.

The sorting table 10 essentially presents itself in the form of a roller conveyor 12, 14 extending in an essentially horizontal way from a first intake end 16 to a second scrap discharge end 18. A hopper 20, and a first series of conveyor rollers 14, adjacent and essentially joined, receive a crop, for example, in the example shown in FIG. 1, a grape harvest 22. The grape harvest, stalks removed, includes both grape berries 24 and debris 26. The debris may consist of leaves, leaf stalks, stems, small twigs etc. The first series of conveyor rollers 14 are driven in rotation, all in the same direction, for the formation of an essentially homogeneous spread of grapes moving in a direction from the first end 16 towards the second end 18 of the sorting table. Rotation of the rollers takes place along rotation axes that are parallel to each other and perpendicular to the plane of the figure.

After the first series of conveyor rollers, a second series of rollers is located which is arranged along the same, essentially horizontal plane. These are conveyor-sorter rollers 12. Just like the conveyor rollers 14 of the first series of rollers the conveyor-sorter rollers 12 are actuated by the same rotational movement to provide the conveying of the grape harvest from the first end 16 towards the second end 18 of the sorting table 10. A direction of conveying is indicated by an arrow 15.

The conveyor-sorter rollers 12 do have another function which is to separate the grape berries 24 from the debris 26 which is of a larger size than the grape berries and/or of a shape that is distinct from the grape berries. It may be debris of a flattened shape such as leaves, or of elongated shape such as leaf stalks, or even bulky items such as stems. As is shown better on the following figures, described further down, the conveyor-sorter rollers form a screen sized for the selective passing of the grape berries 24 through the sorting table. It should be noted that debris items of smaller or same size as the grape berries, such as seeds or small pieces of stems or leaves, for example, can also pass through the screen.

As FIG. 1 shows, as the conveying of the grape harvest proceeds on the sorting table, the grape berries 24 pass through the table and are collected by gravity under the table in a receptacle (not shown).

The debris items 26, by their factor of shape, their weight and/or dimension, do not pass through the screen formed by the conveyor-sorter rollers 14 and reach the second end 18 of the sorting table which amounts to the garbage bin. The debris 26 is collected, in a receptacle, not shown, for disposal or separated evaluation. In the case of a sorting table mounted on a machine the debris is simply discarded from the machine.

With proper adjustment of the screen of the sorting table, all the grape berries can be collected under the sorting table, avoiding grape berries to be discarded together with the debris at the end of the table, which is to say at the second end 18 of the sorting table.

A screen that is too restricted leads to grape berries or more generally fruits being discarded that should have passed through the table. Inversely, a screen that is too wide leads to unwanted debris passing through the sorting table together with the grape berries.

Figure 2A:
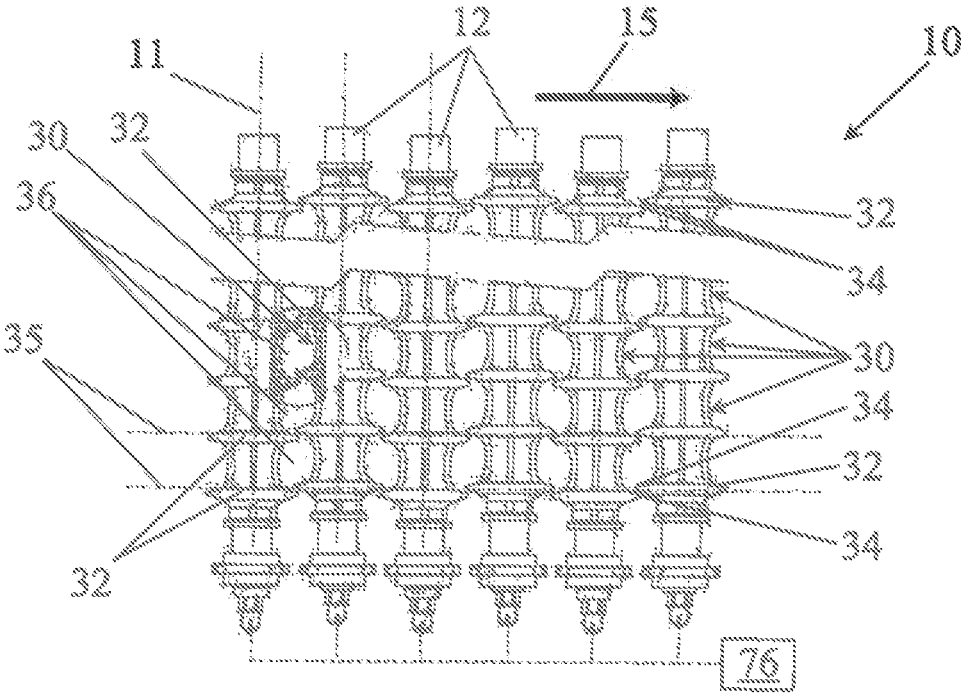
FIGS. 2A and 2B are top views of conveyor-sorter rollers of a portion of the sorting table of FIG. 1.
Figure 2B:
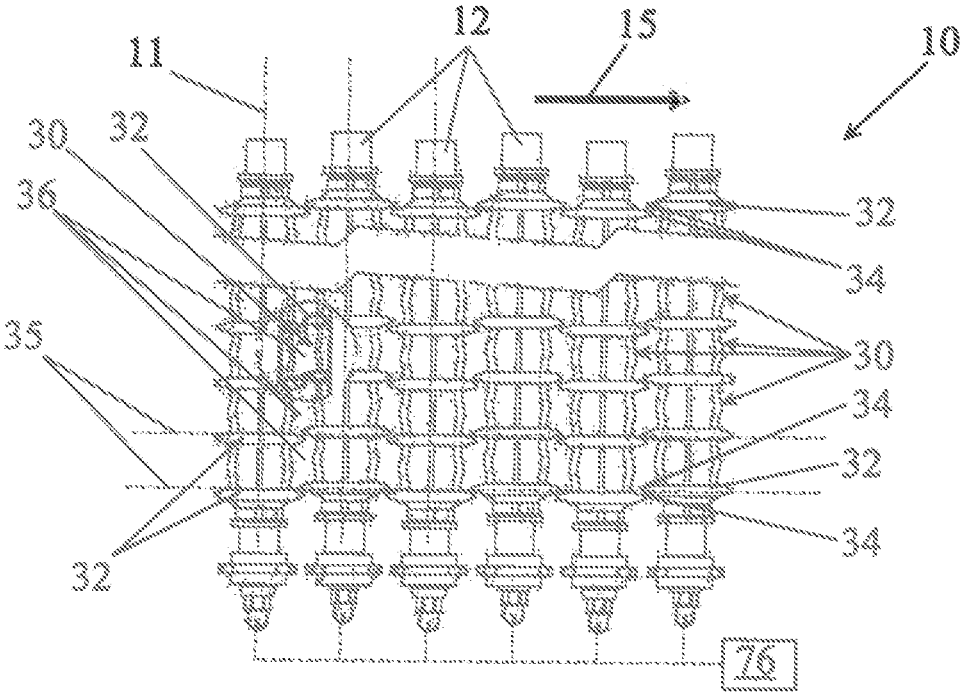

The possibility of adjusting the screen of the sorting table, in conformance with the invention is better understood by comparing FIGS. 2A and 2B.

FIGS. 2A and 2B show only a portion of the sorting table 10. They show a succession of six equidistant conveyor-sorter rollers 12, arranged along axes 11 parallel to each other, perpendicular to the conveying direction 15.

It can be observed that each conveyor-sorter roller 12 includes a plurality of sorter-sections 30. The sorter-sections 30 of a single roller are delimited respectively by annular collars 32. The collars 32 and the sorter-sections 30 present a revolution symmetry around the axis 11 of the corresponding conveyor-sorter roller 12. The collars 32 present a diameter greater than the average diameter of the sorter-sections 30.

The annular collars 32 of the adjacent conveyor-sorter rollers 12 are essentially aligned along the planes 35 perpendicular to the axes 11 of the conveyor-sorter rollers 12 so that their respective ridges 34 are essentially adjacent in a median plane of the sorting table comprising the axes of the conveyor-sorter rollers 12, and in the vicinity of this plane. In the example of implementation illustrated by the FIGS. 2A and 2B, it can be noted that, while being essentially aligned on the planes 35, the annular collars 32 adjacent to the various rollers are slightly offset on either side of these planes, in alternating fashion from one conveyor-sorter roller to the next. In this way they present ridges 34 that are essentially adjacent but also slightly imbricated in the plane of the sorting table.

The sorter-sections 30 of the adjacent conveyor-sorter rollers and the annular collars 32 which separate them thus delimit spaces or openings 36 in the sorting table through which the grape berries, or more generally the fruits can pass, especially by gravity, as the crop or grape harvest is being conveyed.

The regular disposition of the sorter-sections 30 and of the collars 32 assure that the spaces 36 constitute a regular mesh of the screen of the sorting table.

In conformance with the invention, the diameter of the sorter-sections is adjustable. In the example of implementation of FIGS. 2A and 2B all sections are of the adjustable type. FIG. 2A shows the sorter-sections with a smaller diameter than that of the of the sections of FIG. 2B. The spaces 36 and thus the opening of the screen are greater on FIG. 2A than on FIG. 2B. The adjustable character of the diameter of the sorter-sections does not necessarily imply that it is constant over the entire length of a given sorter-section. One can observe, on FIG. 2A, a concave shape of the sorter-sections 30 from their edges on, that is to say from the annular collars 32 to their middle.

Figure 3:
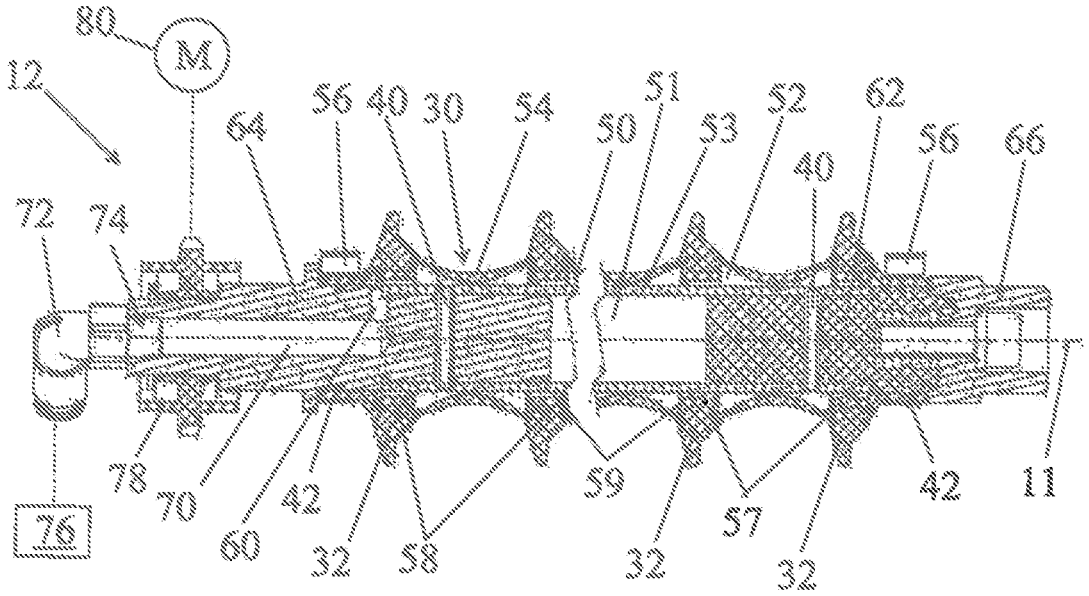
FIG. 3 is an axial section of a conveyor-sorter roller of the sorting table.

FIG. 3 is a sectional view of a conveyor-sorter roller 12 of the sorting table.

The roller includes a central shaft 50 formed, essentially, by an elongated cylindrical tube 53. The tube 53 is for example a tube of stainless steel, of aluminum or a tube made from composite fiber. On the central shaft 50 is fitted a sleeve 54 made of natural material or a deformable thermoplastic elastomer, for example of rubber or polyurethane, preferably compatible with contact of foodstuffs. The ends of the cylindrical tube 53 are closed by plugs 62, 64, partially pressed into the cylindrical tube 53 and connected in rotation with the tube through cotter pins 40. A first plug 62 receives a fitting 66 for the reception of a rolling bearing (not shown), and intended for installation of the conveyor-sorter roller 12 on a chassis of the sorting table. The opposite end of the cylindrical tube 53 receives a second plug 64, also meant to receive a rolling bearing (not shown).

The sleeve 54 is maintained on ends of the central shaft 50 and more precisely on a part of the plugs 62, 64, A tight junction is achieved by means of rings 56, combined with joints 42, for example O-ring joints, and placed on the plugs 62, 64. The sleeve 54 constitutes an exterior deformable wall of an internal chamber 52. The internal chamber 52 is also delimited by a rigid wall, opposite the deformable wall, and formed [by] the cylindrical tube 53 of the central shaft 50. The sleeve 54 forms the sorter-sections 30. The internal chamber 52 extends between the sleeve 54 and the central shaft 50, and presents compartments in each sorter-section 30 of the conveyor-sorter roller.

The sleeve 54 presents annular grooves 58 between sorter-sections 30. The annular grooves 58 receive the annular collars 32. In the example of FIG. 3, the collars 32 are made of a plastic material that is harder and more rigid than that of the sleeve 54. The collars participate in the maintenance of the sleeve 54 on the cylindrical tube 53 forming the central shaft 50. They prevent the deformation of the sleeve at the height of the annular grooves 58 and maintain support soles 59 of the sleeve 54, opposite the annular grooves 58, in contact with the wall of the cylindrical tube 53. Recess passages 57 are formed in the support soles 59 so as to create a fluid passage between the different compartments of the internal chamber 52 corresponding to the different sorter-sections 30.

The second plug 64 includes a canal 70 from a fitting 72. The canal 70 is connected to the internal chamber 52 through the intermediary of one or several passages 60 crossing the plug 64. The canal 70 is thus in fluid communication with the internal chamber 52 and with the sleeve 54. The passage 60 represented on FIG. 3 opens between the tight junction of the sleeve 54 on the second plug 64 and the end of the cylindrical tube 53. In another mode of implementation, (not shown), passages towards the internal chamber 52 can also be made in the wall of the cylindrical tube 53. These passages establish communication between different parts of the internal chamber, corresponding to the different sorter-sections, and put the internal chamber in communication with the interior of the cylindrical tube 53. In this case, the canal 70 can lead directly into an internal space 51 of the cylindrical tube 53. The fitting 72 is mounted on the second plug 64 through the intermediary of a revolving joint 74. It is also connected to a fluid source 76 with controlled pressure, represented symbolically. The source of fluid under pressure constitutes, or at least is part of, in this mode of implementation, the control device of the diameter for the sorter-sections with adjustable diameter. The source of pressure-controlled fluid 76 may be, for example, a pneumatic energy installation from a pit, with a pressure valve. It may also feature a compressor and a pressurized air reservoir or a vacuum pump.

The fluid source may also feature an air distributor block and pressure limiters so as to supply with different pressures the various sorter rollers 12 or different sorter roller groups 12.

Finally, the second plug 64 receives a driving pinion 78 intended to drive the conveyor-sorter roller 12 in rotation. The driving pinion is connected to an electric or hydraulic motor 80 represented symbolically by a chain or gear transmission for example. The motor 80 may be equipped with a speed variator to vary the rotational speed of the conveyor-sorter rollers 12.

When the source of pressure-controlled fluid 78 is above the atmospheric pressure the fluid under pressure enters the internal chamber 52 of the conveyor-sorter roller in order to expand the sleeve 54. The sleeve is inflated, like an air chamber. However, due to the collars 32 which retain the sleeve 54 at the height of its grooves 58, the expansion of the sleeve is limited to the sorter-sections 30 and in particular to the middle of the sorter sections. This results nevertheless in an increase of the average diameter of the sorter sections by deformation of the sleeve towards the exterior.

During a pressure release, the elasticity of the sleeve makes it find again its position shown in FIG. 3, against the central shaft 50. In this case the diameter of the sorter-sections 30 diminishes. A decrease of the diameter of the sorter-sections can also be achieved from a resting position away from the central shaft 50 and by applying a pressure release to the internal chamber 52.

Figure 4:
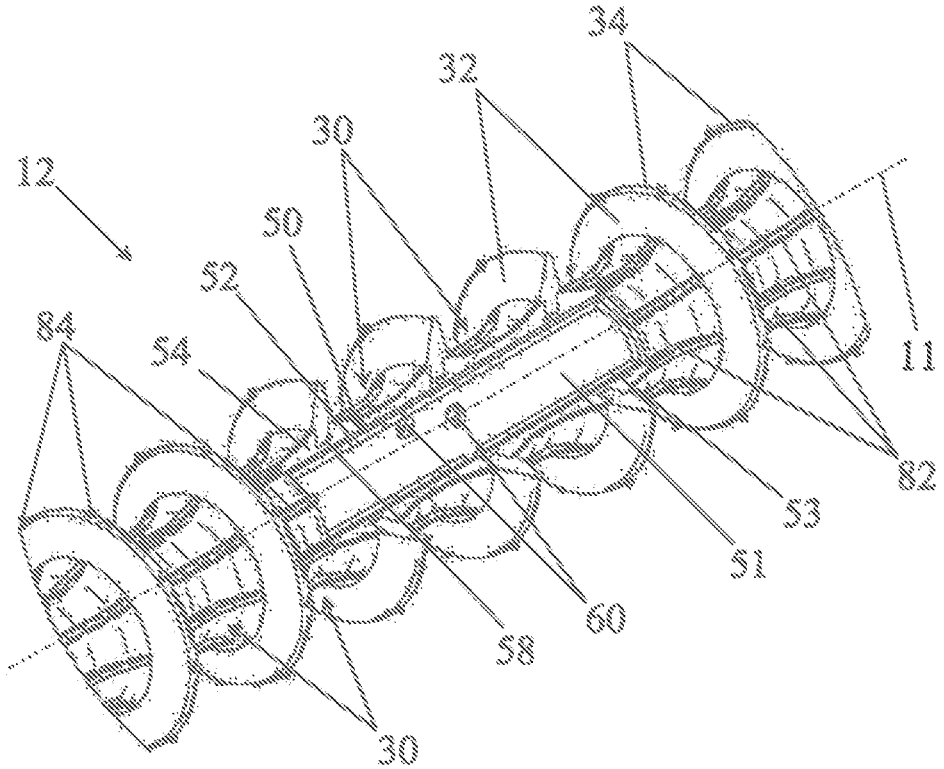
FIG. 4 is a partial view of a conveyor-sorter roller with a partial tear-out, illustrating a possibility of implementation of such a roller.

FIG. 4 shows in perspective a portion of a conveyor-sorter roller 12 in a form of implementation that is very close to FIG. 3, in a configuration where the canal 70, visible on FIG. 3, leads to the internal space 51 of the cylindrical tube 53. A tear-out shows the sleeve 54 resting on the central shaft 50 formed by a cylindrical tube 53. The space between the sleeve 54 and the wall of the central shaft 50 defines an internal chamber 52. The tear-out makes it also possible to see fluid passages 60, in particular air passages which put the internal space 51 of the cylindrical tube 53 in fluid communication with the internal chamber 52, and particularly its compartments corresponding to the different sorter-sections 30.

FIG. 4 also shows the collars 32 seated in the annular grooves 58 of the sleeve.

Finally, FIG. 4 shows reliefs 82 and 84 which equip respectively the sorter-sections 30 and the ridges 34 of the collars 32. The function of the reliefs 82, 84 is to improve the movement of the fruits to be sorted.

The reliefs 82 on the sorter-sections are ribs which extend along planes containing a rotational axis 11 of the sorter roller 12. They are preferably made of the same material as that of the sleeve 54. They may also be made of a harder material than that of the sleeve 54. It may for example be the same plastic material as the collars 32. The ribs of the sorter-sections also participate in the movement of the fruits across the screen of the sorting table.

The reliefs 84 on the ridges of the collars 32 are pins with a regular angular spacing. They serve for the conveying of the crop or grape harvest to be sorted and participate in directing the debris by reducing the risk of their passing through the screen of the sorting table.

Figure 5:
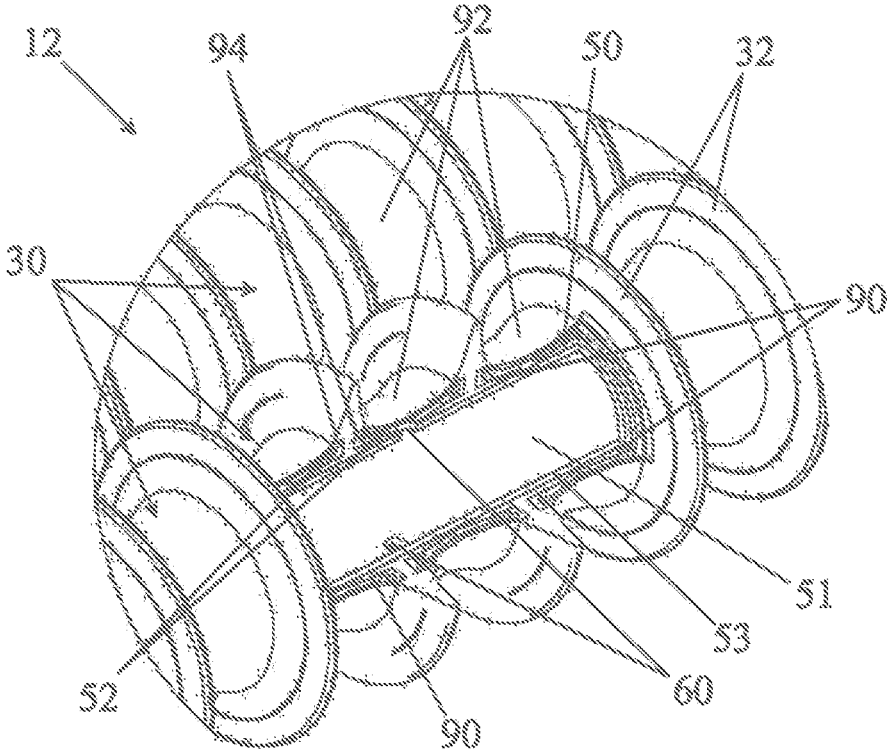
FIG. 5 is a partial view of a conveyor-sorter roller with a partial tear-out, illustrating another possibility of implementation of such a roller.

FIG. 5 shows another possibility of manufacturing conveyor-sorter rollers 12.

A tear-out of FIG. 5 shows that, contrary to FIG. 4, the collars 32 are no longer mounted in the grooves of a sleeve forming sorter-sections. On FIG. 5 the collars 32 each present a cylindrical base 90 with an internal diameter adjusted to the central shaft 50. The central shaft 50 is here also constituted by a cylindrical tube 53 including an internal space 51.

The cylindrical base 90 also has a function of spacing the collars 32. In effect the different collars 32 are pressed on the central shaft 50, respectively with their cylindrical bases 90 in contact. The collars 32 are thus at equal distance from each other.

The sorter-sections 30 are formed by annular membranes 92 integral respectively with two successive collars 32. The membranes 92 present ends seated in annular grooves 94 made on either side of each collar 32 in the vicinity of its cylindrical base 90. They form sheaths around the central shaft and present a symmetry of revolution. The space comprised between the annular membranes 92 and the cylindrical bases 90 of the collars 32 defines multiple internal chambers 52 corresponding respectively to sorter-sections 30.

One can observe the presence of passages 60 made in both the cylindrical tube 53 of the central shaft 50 and in the cylindrical bases 90 of the collars 32. The passages 60 make it possible to put in fluid communication the internal space 51 of the cylindrical tube 53 with the different internal chambers 52 of the conveyor-sorter roller 12 and thus with the internal face of the membranes 92.

When the internal chambers 52 are put under pressure, the pressurized fluid, for example pressurized air, will expand the membranes 92. This has the effect of increasing the average diameter of the sorter-sections 30. Since the ends of the membranes 92 are maintained in the annular grooves 94 of the collars, the membranes deform themselves essentially in their environment.

Figure 6:
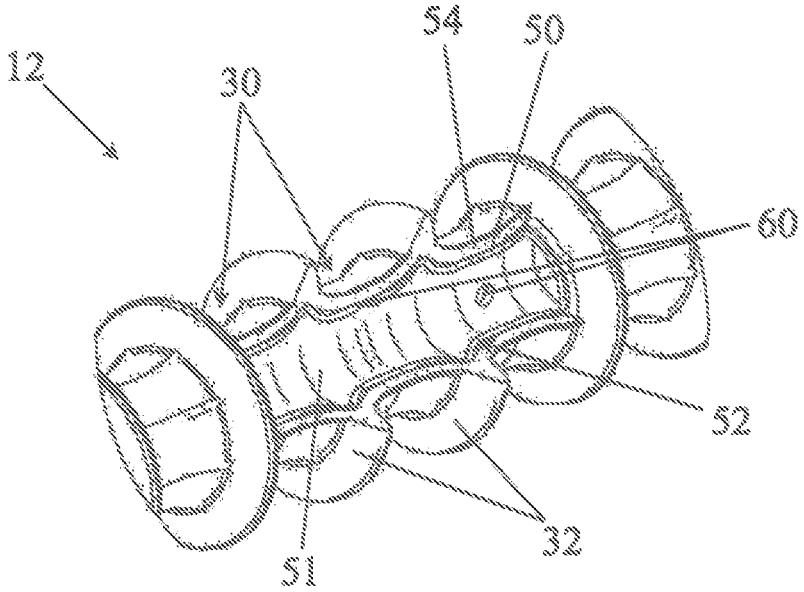
FIG. 6 is a partial view of a conveyor-sorter roller with a partial tear-out, illustrating yet another possibility of implementation of such a roller.

FIG. 6 shows yet another possibility of producing conveyor-sorter rollers 12.

The mode of implementation of FIG. 6 resembles that of FIG. 4 to the extent that the sorter-sections 30 are formed by a sleeve 54 in a deformable plastic material. The collars 32 are formed of one piece with the sleeve 54 and constitute excessive thickness of the sleeve. The excessive thickness of the material forming the sleeve 54 has the effect of increasing its rigidity and to reduce the possibility of deformation for the collars 32. The collars 32 are thus not deformed, or at least only very little deformed when pressure is applied and when the diameter of the sorter-sections 30 is modified.

The central shaft 50, although it presents a symmetry of revolution, is not cylindrical. It presents an undulated relief obtained, for example, by hydroforming. The relief of the central shaft corresponds to the alternation of the sorter-sections 30 and the collars 32. This disposition ensures maintenance of the distance of the sorter-sections 30.

Figure 7:
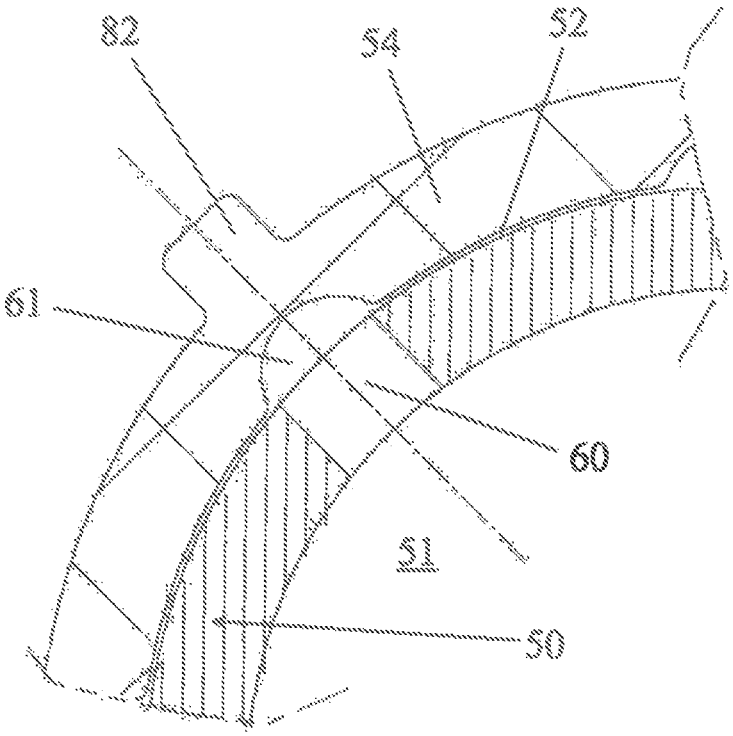
FIG. 7 is a partial sectional drawing of a detail of the conveyor roller of FIG. 6.

FIG. 7 shows in a sectional view, perpendicularly to one of the sorter-sections of FIG. 6, a detail of the sleeve 54 resting on the central shaft 50. One can observe a canal 61 provided in the sleeve 54 opposite a relief 82 of the sleeve. The canal 61 is flush with an internal face of the sleeve 54. It extends axially along the sorter-sections 30 and passes under the collars 32 represented in FIG. 6. The canal 61 facilitates the fluid communication of the sleeve 54 with the internal space 51 of the central shaft 50. The canal 61 connects the different compartments of the internal chamber 52 corresponding to the different sorter-sections 30 of the conveyor-sorter roller 12. In this way, it contributes to distributing the pressure in the different compartments of the internal chamber 52 for a uniform increase in the diameter of all the sorter-sections, especially at the beginning of a pressurization. After a diameter control pressure of the sorter-sections has been established, the sleeve 54 rises from the central shaft and constitutes itself a wall of the internal chamber 52 in the areas corresponding to the sorter-sections.

Figure 8:
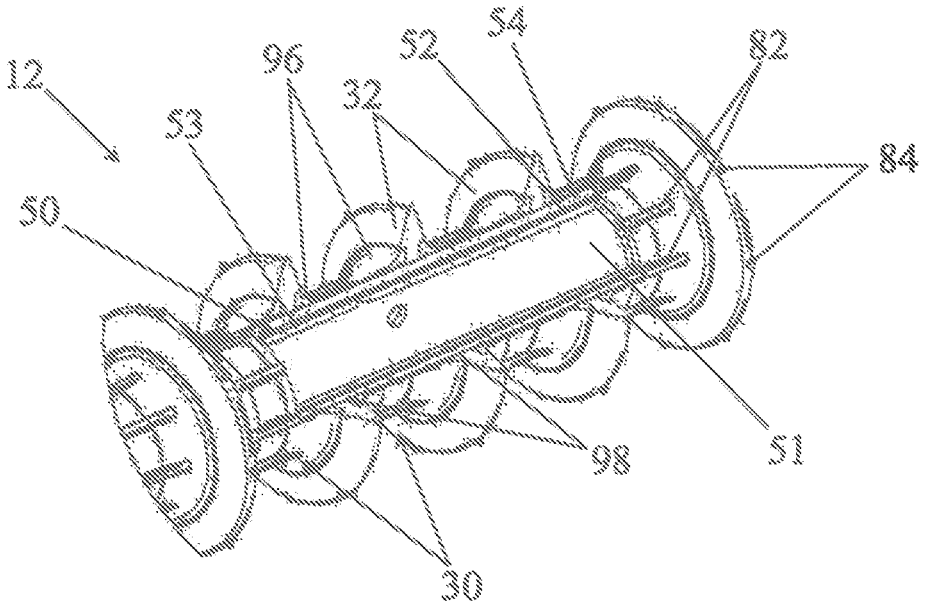
FIG. 8 is a partial view of a conveyor-sorter roller, with a partial tear-out illustrating yet another possibility of implementation of such a roller.

FIG. 8 shows yet another possibility of producing conveyor-sorter rollers 12. It also ressembles the mode of implementation of FIG. 4 to the extent that the wall of the sorter-sections 30 is formed by a sleeve 54 which extends continuously on the central shaft 50.

In the mode of implementation of FIG. 8, the collars are provided with soft annular lips 96 extending on both sides of the collar on the sorter-sections 30. The soft lips 96 are fixed in annular grooves 98 of the collars 32, in the vicinity of the sleeve 54. Theses grooves are comparable to the grooves 94 seating the annular membranes 92 of FIG. 5.

Unlike the annular membranes 92 of FIG. 5, the annular lips 96 of FIG. 8 extend only over a portion of the axial length of the sorter-sections 30. They rest on the external face of the sleeve 54. The annular lips 96 accompany the deformation of the sorter-sections 30 during an adjustment of their diameter. This mode of implementation makes for simpler manufacture, by extrusion for example, of the sleeve 54 and makes it possible to regain a concave shape of the sorter-sections 30, a shape that is better suited particularly to the conveying of long debris items such as leaf-stalks.

In an alternative mode of implementation not shown here, the sorter-sections 30 can be formed by associating a sleeve 54 and similar collars 32 with those of FIG. 8, but not including additional annular lips 96. This solution is more economical and allows simplifying the washing operation of the conveyor-sorter rollers.

Figure 9:
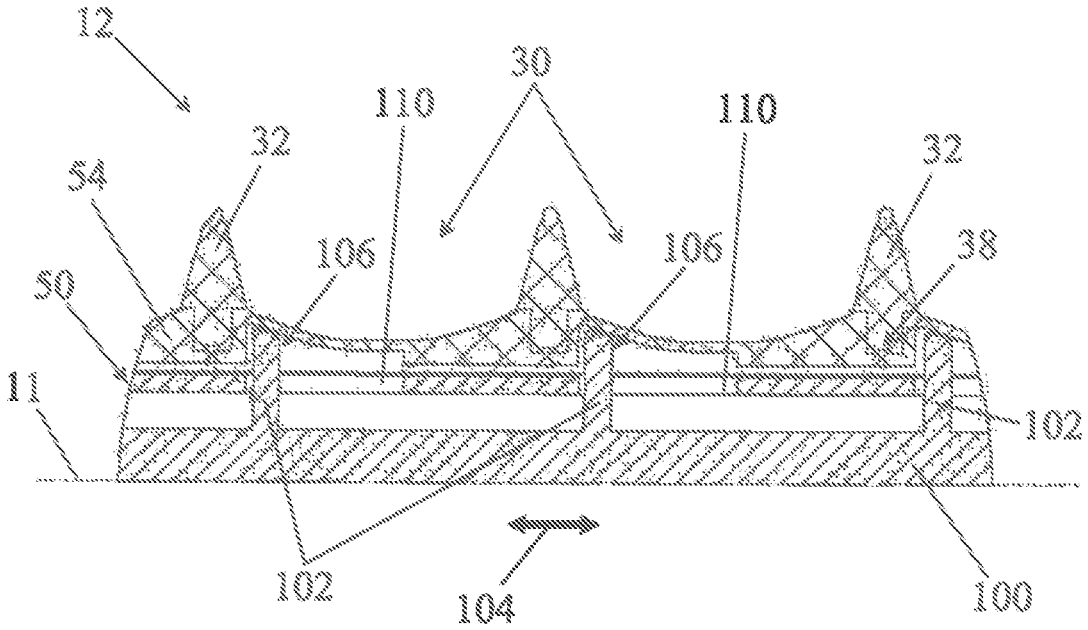
FIG. 9 is a partial view of a conveyor-sorter roller, illustrating yet another possibility of implementation of such a roller.

FIG. 9 shows a possibility of implementation of a conveyor-sorter roller 12 in which the control device of the diameter of the sorter-sections does not use a pressure-controlled fluid for varying the diameter of the sorter-sections 30, but mechanical actuation shaft.

Like the conveyor-sorter roller of FIGS. 3 and 4, the conveyor-sorter roller 12 of FIG. 9 presents a central shaft 50 covered by a sleeve 54 forming essentially the sorter-sections 30. Collars 32 are seated in grooves 38. They form with the sorter-sections 30 an alternating succession according to a succession pattern. In the example of FIG. 9 the pattern of succession is regular. Thus the sorter-sections 30 all have the same length and the collars 32 are regularly spaced along the axis 11 of the roller.

Inside the central shaft 50 is a concentric actuating shaft 100. The actuating shaft 100 is provided with a plurality of humps 102 arranged on the one hand according to the same succession pattern as the sorter-sections and the collars and on the other hand spread angularly in a uniform way in a plane perpendicular to the axis 11 of the conveyor-sorter roller. In other words, the spacing of the humps 102 along the axis 102 corresponds here to that of the collars 32 and also of the sorter-sections 30. The humps 102 traverse the central shaft 50 in elongated slots 110 provided for this purpose.

The actuating shaft 100 presents, relative to the central shaft 50, the ability to slide indicated by a dual arrow 104. The actuating shaft can thus slide between a first position in which the humps 102 are located in a seat 106 in the vicinity of the collars 32, at the edge of the sorter-sections 30, and a second position in which the humps 102 are essentially aligned with the middle of the sorter-sections 30.

In the first position which is the one visible on FIG. 9, the humps do not interact with the sleeve 54. For each sorter-section 30 the sleeve 54 presents, along the axis 11 of the conveyor-sorter roller. A concavity the center of which coincides essentially with the middle of the sorter-section 30.

In the second position the humps 102 of the actuating shaft raise the wall of the sorter-sections 30 in their middle, relative to the axis 11. This lifting action has the effect of increasing the diameter of the sorter-sections, namely by reducing or eliminating their concavity.

The actuating shaft of the conveyor-sorter rollers can be moved between the first position and the second position, for example, by an electromagnetic control, a mechanical control, a pneumatic control or a hydraulic control, for the adjustment of the diameter of the sorter-sections and thus of the opening of the screen of the sorting table equipped with it. These elements are part of the control device of the diameter of the sorter-sections with adjustable diameter.

The invention claimed is:

1. A sorting table for fruit, the sorting table comprising:
a succession of conveyor-sorter rollers arranged along a sorting plane, the conveyor-sorter rollers of said succession of conveyor-sorter rollers being parallel to each other, the conveyor-sorter rollers each having at least one sorter section, adjacent sorter sections facing each other having a space therebetween, the space adapted to allow the fruit to pass therethrough, wherein the at least one sorter-section of the conveyor-sorter rollers has an adjustable diameter; and
a control device cooperative with the conveyor-sorter rollers so as to control the adjustable diameter of the at least one sorter-section of the conveyor-sorter rollers.

2. The sorting table of claim 1, wherein the at least one sorter-section has a deformable wall.

3. The sorting table of claim 2, wherein said control device has a source of pressure-controlled fluid, the conveyor-sorter rollers each having at least one internal chamber in fluid communication with the deformable wall.

4. The sorting table of claim 3, wherein the deformable wall is a wall of the at least one internal chamber.

5. The sorting table of claim 3, wherein the at least one internal chamber has a rigid wall, the deformable wall forming a sheath around the rigid wall.

6. The sorting table of claim 2, wherein the at least one sorter section comprises a plurality of sorter sections arranged along a roller axis, the plurality of sorter-sections being respectively separated by annular collars protruding outwardly of the plurality of sorter-sections.

7. The sorting table of claim 6, wherein the annular collars are aligned along planes perpendicular to the conveyor-sorter rollers and having adjacent ridges.

8. The sorting table of claim 6, wherein the annular collars are mounted on a central shaft.

9. The sorting table of claim 8, wherein the plurality of sorter-sections respectively have a membrane mounted between a pair of successive annular collars, the membrane forming the deformable wall.

10. The sorting table of claim 8, wherein the annular collars respectively have a cylindrical base adjustable relative to the central shaft, the cylindrical base forming a space between the annular collars.

11. The sorting table of claim 2, wherein the conveyor-sorter rollers respectively have a sleeve forming the deformable wall respectively of the at least one sorter-section.

12. The sorting table of claim 11, wherein the sleeve has an area of greater thickness that forms an annular collar.

13. The sorting table of claim 11, wherein the sleeve has an annular groove, an annular collar being received in the annular groove.

14. The sorting table of claim 6, wherein the annular rollers respectively have at least one flexible annular lip that rests on an adjacent sorter-section.

15. The sorting table of claim 2, wherein the plurality of sorter-sections respectively have a relief thereon.

16. The sorting table of claim 15, wherein the relief is formed of a material that is harder than a material of the deformable wall.

17. The sorting table of claim 2, wherein the conveyor-sorter rollers have an alternating succession in accordance with a succession pattern, the at least one sorter-section comprising a plurality of sorter-sections in which a protruding annular collar separates adjacent sorter-sections of the plurality of sorter-sections, wherein said control device has an internal actuating shaft concentric to the deformable wall of the plurality of sorter-sections and to the protruding annular collar, the internal actuating shaft having humps spaced in accordance with the succession pattern, the internal actuating shaft being axially slidable between a first position and at least one second position, the humps being received in seats adjacent to the annular rollers in the first position, the humps coinciding with the plurality of sorter-sections in the at least one second position.

18. The sorting table of claim 1, wherein conveyor-sorter rollers each comprise:

a cylindrical central shaft having a first diameter;

a plurality of annular collars arranged along said cylindrical central shaft, said control device comprising:

a plurality of sleeves coaxial to said cylindrical central shaft each having a second diameter, the second diameter being greater than the first diameter, said plurality of sleeves being slidable between a first position in which said plurality of sleeves are retracted under the plurality of annular collars and a second position in which said plurality of sleeves extend into spaces between the plurality of annular collars, the at least one sorter-section being formed by either said cylindrical central shaft or by said plurality of sleeves in the second position.

* * * * *